US006076533A

United States Patent [19]

Cohen et al.

[11] Patent Number: 6,076,533

[45] Date of Patent: Jun. 20, 2000

[54] METHOD FOR MAKING A COSMETIC PACKAGE CONTAINING A DECORATIVE GEL

[75] Inventors: Isaac David Cohen, Brooklyn; Jennifer L. Oko, Stony Brook; Marie A. Albers, West Islip, all of N.Y.

[73] Assignee: Color Access, Inc., Melville, N.Y.

[21] Appl. No.: 09/353,219

[22] Filed: Jul. 14, 1999

[51] Int. Cl.[7] ..... A45D 33/02

[52] U.S. Cl. ..... 132/298; 132/293; 132/305; 206/823; 220/366

[58] Field of Search ..... 132/293, 294, 132/295, 298, 305, 306, 307; 206/449, 581, 823, 229; 220/254, 256, 303, 306, 307, 360, 366

[56] References Cited

U.S. PATENT DOCUMENTS

| | | | |
|---|---|---|---|
| 2,421,646 | 6/1947 | Pepin | 132/293 |
| 2,737,189 | 3/1956 | Morningstar et al. | 132/293 |
| 4,162,010 | 7/1979 | Hovsepian | 206/823 |
| 4,314,897 | 2/1982 | Monte et al. | 206/449 |
| 5,001,907 | 3/1991 | LaCroix et al. | 206/449 |
| 5,189,531 | 2/1993 | Palmer et al. | 132/293 |
| 5,799,675 | 9/1998 | Gunderman et al. | 132/333 |

*Primary Examiner*—Gene Mancene
*Assistant Examiner*—Pedro Philogene
*Attorney, Agent, or Firm*—Kenyon & Kenyon

[57] ABSTRACT

The present invention relates to a method of making a cosmetic container having a surface with a decorative feature that is visible through a clear cosmetic product contained by the container. The present invention also includes a cosmetic container comprising a decorative feature at or near the bottom of an insert placed inside of the container. The decorative feature is observed as part of the product by the user while applying the cosmetic product. The decorative feature remains in tact during continued use of the product and lasts at least as long as the life of the cosmetic product.

29 Claims, 4 Drawing Sheets

METHOD FOR MAKING A COSMETIC PACKAGE CONTAINING A DECORATIVE GEL

FIELD OF THE INVENTION

The invention relates to a method for making a cosmetic package interior for a clear cosmetic gel product. More specifically, the invention relates to cosmetic products comprising a dextrin fatty acid ester combined with a mixture of polymeric hydrocarbons presented in a package containing a decorative feature that is visible through the cosmetic gel product. The cosmetic package includes pots for lip gloss as well as compacts for perfume products.

BACKGROUND OF THE INVENTION

Products that are attractive draw the attention of potential consumers and are pleasant to look at when used by actual consumers. Therefore, product suppliers want to present makeup products that look appealing and have attractive eye-catching decorative features. One such means of making an attractive cosmetic product package is to have special designs on the package. However, many typical makeup products are contained within packages that are not transparent and when they are opened for the consumer to examine and use the actual cosmetic product, the external decorative features of the package are no longer in view or are not as observable as they were before the package was opened. It is also common to emboss or screen print a pattern or logo on a surface of a product to be used as disclosed, for example, in U.S. Pat. No. 5,799.675. Again however, once use of the product is initiated, the pattern is disturbed and/or destroyed, thereby providing at best a fleeting visual interest to the consumer.

Accordingly, to present an attractive decorative feature contemporaneously with the use of the product (i.e., while the package is open), it is desirable to adorn the interior portion of the package so that it appears as attractive as the exterior portion of the package. To achieve this, clear films or plastic sheets covering the cosmetic product may include certain designs, patterns or lettering. Other interior regions of the package may also include similar decorative features. However, while the package is open and the user applies the cosmetic product to test it, the focus is on the cosmetic product itself. Therefore, the attention of the potential consumer is diverted away from any design on the inside of the cover or even the film. This is especially true in the case of the film, as many films or sheets are intended or in fact removed to provide access to the cosmetic product. Therefore, during application and use of the product, the internal attractive feature may no longer be present or at best it is inconspicuous.

There remains a need for cosmetic product packaging which can confer an attractive internal appearance while the package is open and while the consumer applies and uses the product. The present invention provides such a product.

SUMMARY OF THE INVENTION

The invention relates to a container for receiving a clear cosmetic product which has at least one decorative feature that is visible through and optically integral with the clear cosmetic product. The container has a base and at least one sidewall which extends upwardly from the base and defines at least one internal chamber within the container. The base has an upper and a lower surface. The decorative feature is on at least one of the surfaces of the base such that the feature is observable through the product. The feature appears, similar to an optical illusion, as though the clear cosmetic product actually contains the feature in it. The image of the feature is undisturbed by removal of the clear cosmetic product by the user during application, and therefore, lasts for the duration of the life of the clear cosmetic product.

The chamber can contain the clear cosmetic product itself or it can contain an insert which holds the clear cosmetic product. The insert has a bottom contiguous with the base and a rim contiguous with the sidewall. The bottom has an upper face and a lower face. The decorative feature is located on at least one of the faces, at least one of the surfaces or a combination thereof, as long as the feature is visible through the product and the feature appears to be part of the product.

The present invention also includes a method of making a container that has a decorative feature observable through the product even when the cosmetic product is being applied. The decorative feature lasts at least as long as the product is available in the container. Specifically, the method includes setting the feature on the base of the container and pouring the clear cosmetic product into the chamber such that the decorative feature is covered by the product. If the product is poured into the insert, the insert containing the product is placed into the chamber of the container. As a result, the decorative feature is visible through the product and appears to be part of the product.

DETAILED DESCRIPTION OF THE INVENTION

Figure 1:
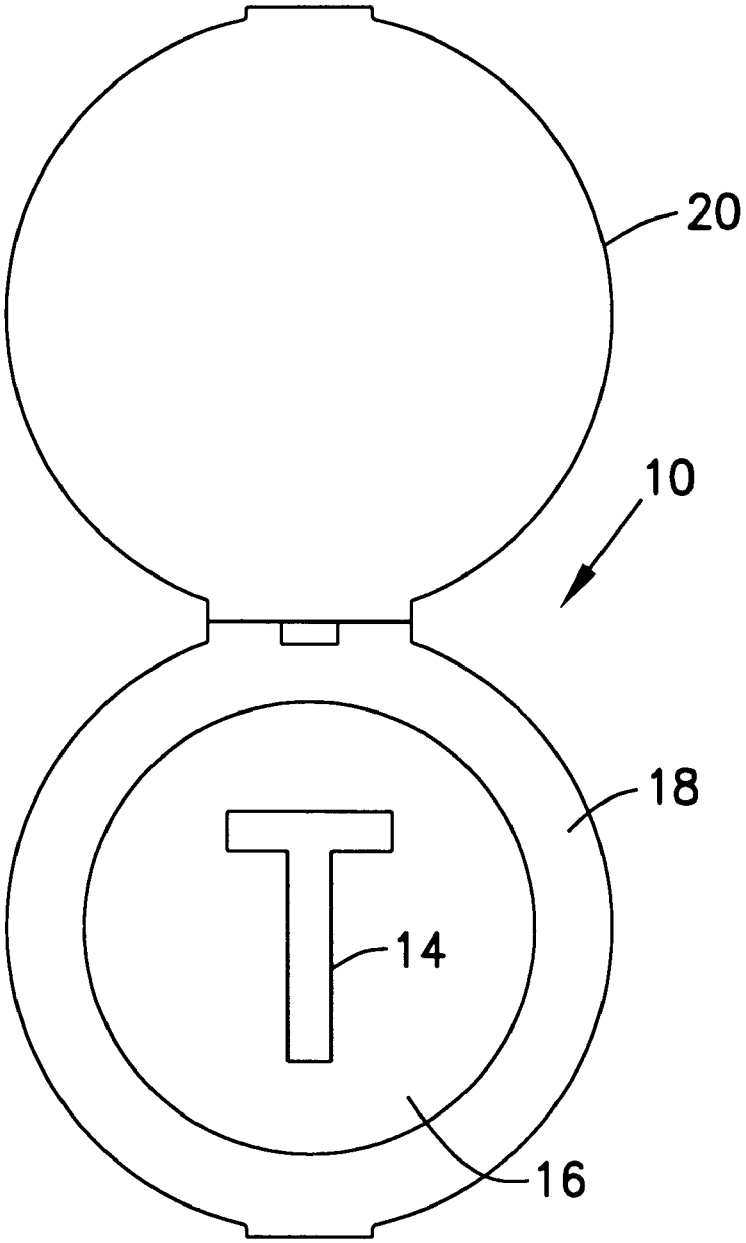
FIG. 1 is a top view of a decorative feature visible through and optically integrated with a cosmetic product held in a container of the present invention.
Figure 2A:
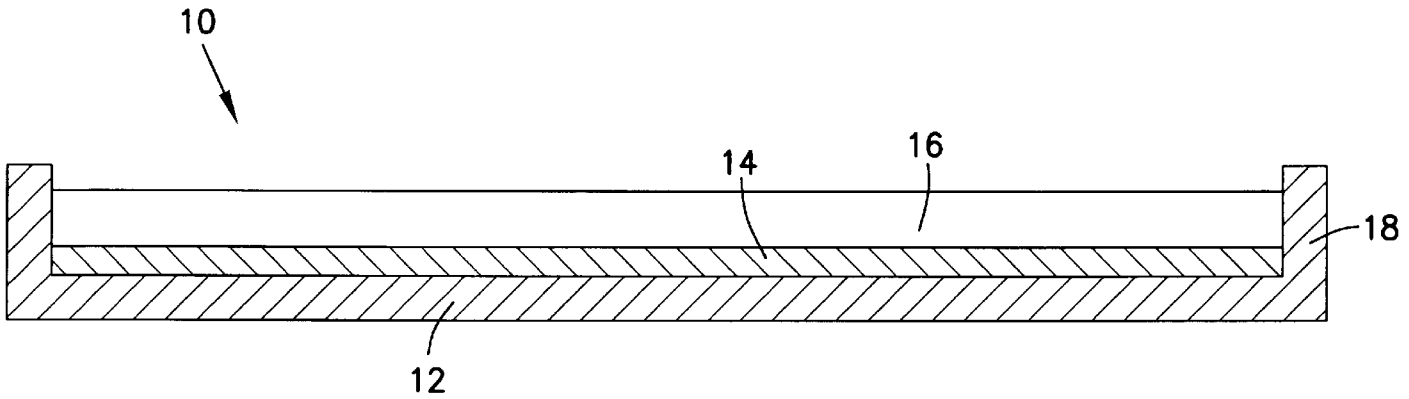
FIG. 2A is a side view of the container of FIG. 1 with the feature on the upper surface of the base of the container.

Referring to FIG. 1, the present invention relates to a container, generally shown at 10, for receiving a clear cosmetic product 16. The container has at least one internal chamber defined by a base 12 and at least one sidewall IS which extends upward from the edge of the base 12 of the container, as shown in FIG. 2A. Thus, the chamber is an integral part of the container 10 that is defined by the sidewall 18 and the base 12. The base 12, illustrated in FIG. 2B, has an upper surface 22 and a lower surface 24. At least one surface has a decorative feature 14 on it and the feature 14 is optically integral with the product. The clear cosmetic product 16 which is confined within the container overlays the feature 14 located at the base 12 of the container such that the decorative feature 14 can be observed through the product 16. This arrangement allows the feature 14 to be prominently observed by the user while the cosmetic product 16 is in use or being applied. Therefore, the feature 14 is on display for the lifetime of the product 16.

The decorative feature 14 can be any type of design that is observable through the clear cosmetic product 16. Examples of decorative features 14 include, but are not limited to, mirrors, holograms, metallic films, photographs, reliefs (i.e., raised images which are part of the container). The feature 14 can be integral with the base 12 or it can be separate from the base 12. Further, the area of the feature 14 can be equal to or less than the area on which it is placed (i.e., the bottom 112 or the base 12). The type of feature 14 selected must be compatible with the product 16 such that it will maintain its image throughout the duration of at least the lifetime of the clear cosmetic product 16. The feature 14 must not be eroded or in any other way be distorted if it is in contact with the product 16.

Preferably, the feature 14 is on the upper surface 22 of the base 12 of the container. However, it is also within the scope of the present invention to have a plurality of features on different surfaces, on the same surface, or a combination thereof. To permit viewing of the feature 14 through the product 16, the base 12 must be transparent when the feature 14 is placed on the lower surface 24 so that the other features 14 are visible through the product 16. And, each feature 14 must permit visibility of any other features 14. When the product 16 is in view, the combination of the features 14 looks like one feature that is part of the product 16. Accordingly, the features 14 can form interweaving patterns with each other to form, for example, a lattice arrangement or other overlapping or intertwining designs. For example, a first feature 14A is located on the upper surface 22 and a second feature 14B is located on the lower surface 24. The first feature 14A is a diagonal line to the left and the second feature 14B is a diagonal line to the right. The remaining area of the upper surface surrounding the feature 14A must be transparent so that when feature 14A is placed above and/or over feature 14B, the diagonal line to the right of feature 14B, is visible in tandem (i.e., overlaps) with the feature 14A, the diagonal line to the left. As a result, an X appears through and is optically integral with the clear cosmetic product 16.

Figure 2B:
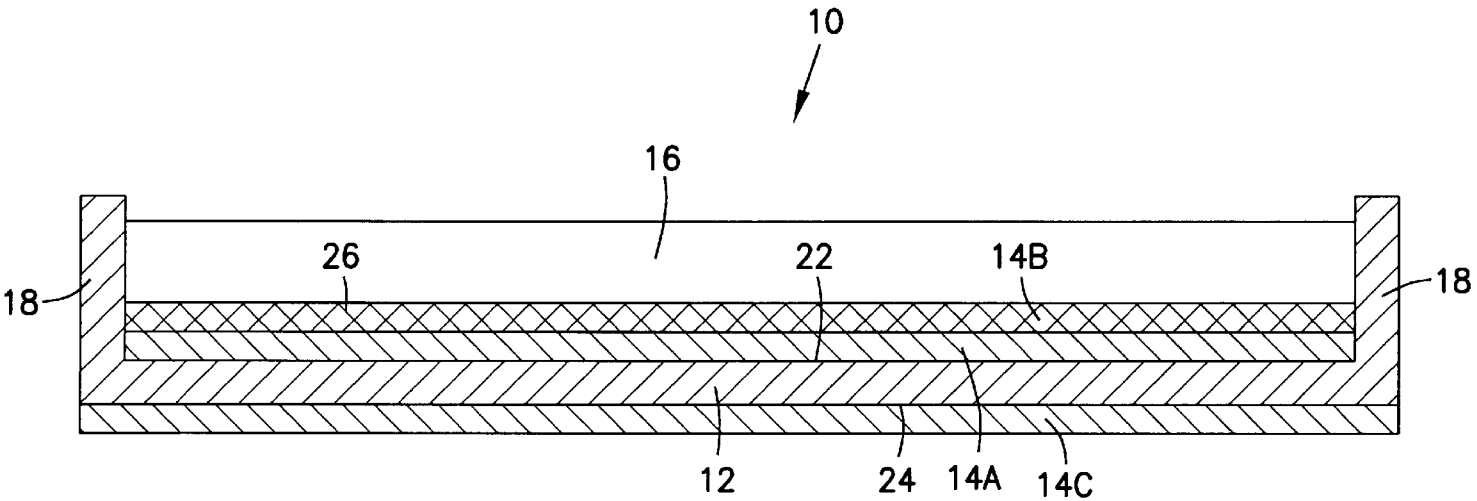
FIG. 2B is a side view of the container of FIG. 2A with the feature on both surf-aces of the base and a clear divider between one of the features and the clear cosmetic product.

In one embodiment, as shown in FIG. 2B, the feature 14 is separate, and it is preferably affixed to the upper surface 22 or the lower surface 24 using adhesives and methods of adhesion known in the art. The feature can contain an adhesive backing such that it is affixed to the base 12 when it is set on one of the surfaces 22, 24. After the feature 14 is set the cosmetic product 16 is poured into the chamber of the container and over the feature 14. The product 16 can be in contact with the feature 14 or the product 16 can be separated from the feature 14. For example, when the feature 14 is placed on the upper surface 22 of the base 12, a clear divider 26 can be placed over the feature 14. The clear divider 26 protects the integrity of the feature 14. The clear divider 26 can be, for example, a film made of plastic, polyurethane, or other materials known in the art for use as a clear divider 26 in contact with a cosmetic product 16. The clear divider 26 can also have a design feature 14; however, the feature 14 on the divider 26 must be one that does not obstruct the optical integration of any other feature 14 with the product.

Alternatively, when the feature 14 is affixed to the lower surface 24, it is separated from the product 16 by the base 12. Therefore, the base 12 must be transparent so that the feature 14 is visible through the product 16, and the base 12 acts as the clear divider 26. Whether the clear divider 26 is integral with the container or is a separate film, the cosmetic product 16 is poured over the feature 14 so that the feature is optically integrated with the product 16.

In another embodiment of the present invention, the feature 14 is integral with the base 12 and the feature 14 contacts the product 16. The feature 14 is integrated with the base by being, for example, embossed or molded. Preferably, the feature 14 integral with the base 12 is a relief produced by embossing the base 12. The relief is made by embossing the base by methods known in the art such as, for example, pressing a die into the base 12. The decorative feature 14 is in the form of a raised relief over which the cosmetic product 16 can be poured. The base can also be molded to include an integral feature, in which case the feature 14 can be a raised relief or be embedded inside the base 12, such as, for example, a mirror embedded in the base. If the feature is embedded inside the base 12, the base must be transparent to permit viewing of the feature 14.

Figure 3B:
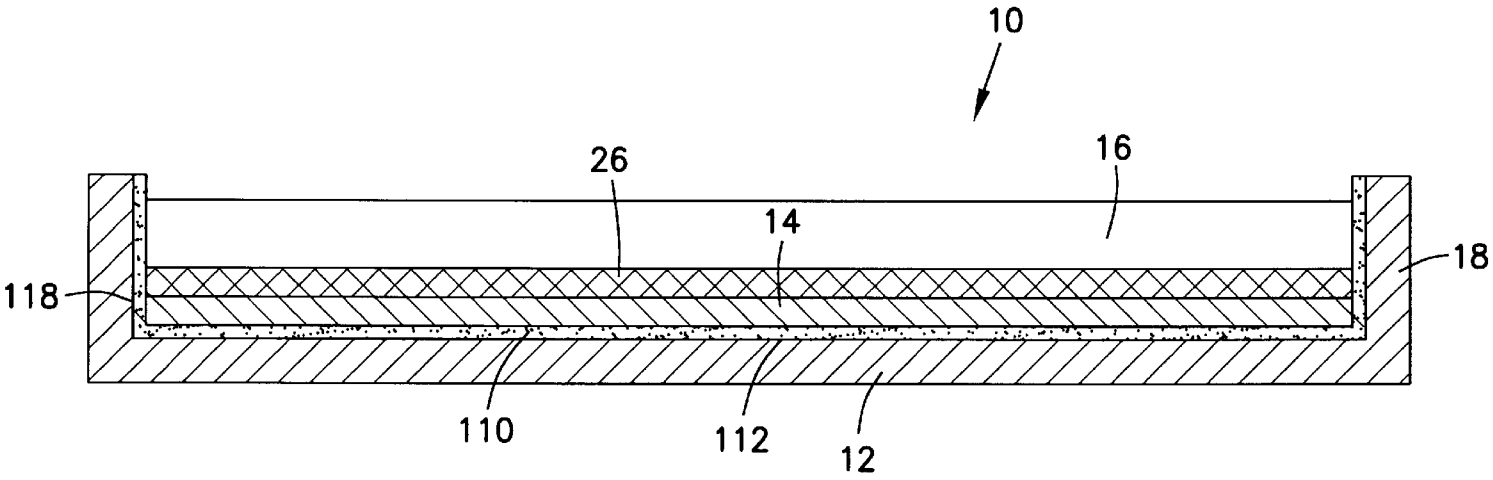
FIG. 3B is a side view of the container with the separate insert of FIG. 3A, the feature on the upper face of the bottom of the insert, and a clear divider.
Figure 3A:
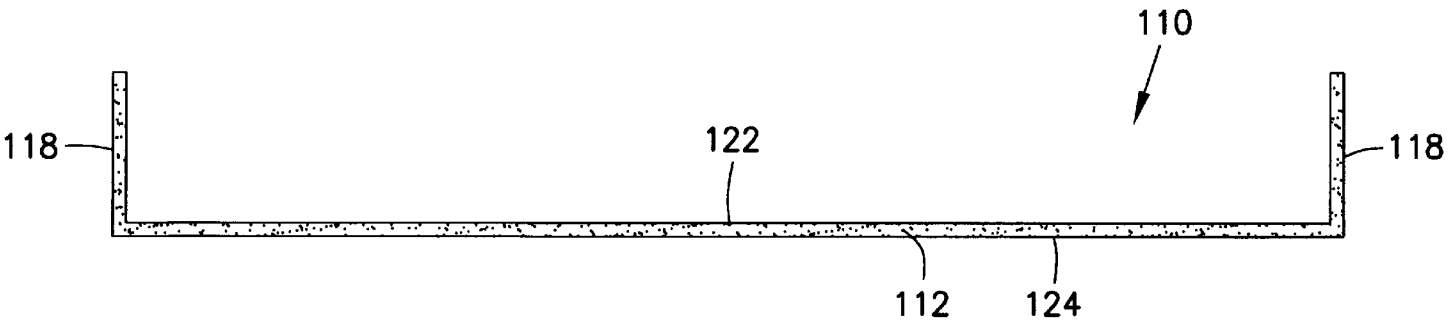
FIG. 3A is a side view of a separate insert.

In yet another embodiment and as shown in FIG. 3B, an insert, generally indicated at 110, placed inside of the chamber contains the product 16, and has at least one decorative feature 14 visible through and optically integral with the product. The insert 110, as illustrated in FIG. 3A, has a bottom 112 and at least one rim 118. When insert 110 is placed inside of the chamber, the bottom 112 and the rim 118 are contiguous with the base 12 and the sidewall 18. The bottom 112, like the base 12 of the container, has an upper face 122 and a lover face 124, and the feature 14 can be placed on either of the faces 122, 124. The bottom 112 of the insert can also be transparent, such that when the feature 14 is placed on the lower surface 124 of the bottom 112 it is visible through the bottom 112 and the product 16. When the feature 14 is placed on the upper surface 122, a clear divider 26 can also be placed between the feature 14 and the product 16 in the insert 110.

Figure 4:
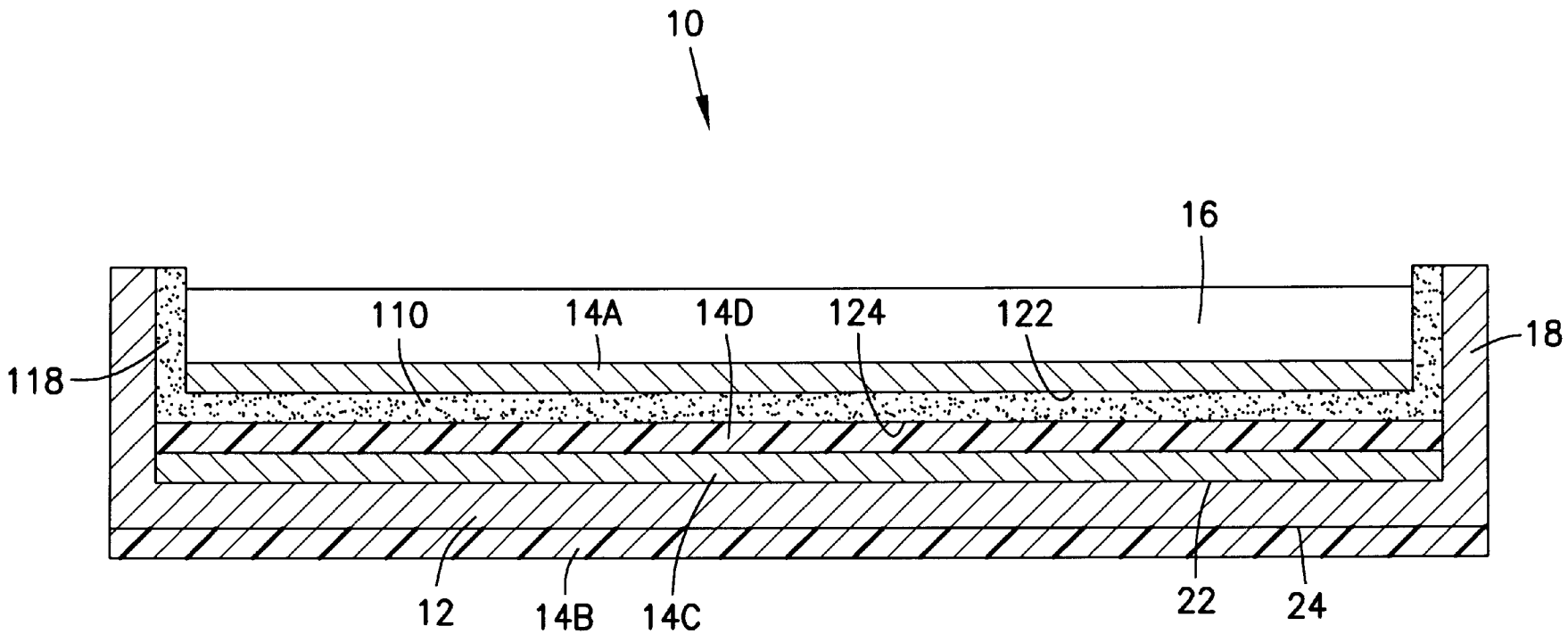
FIG. 4 is a side view of the container with a separate insert and a feature on both surfaces of the transparent base of the container and on both faces of the transparent bottom of the insert.

When a plurality of features 14A, 14B, 14C, 14D are located on more than one of the faces 122, 124, more than one of the surfaces 22, 24 of the base 12 of the container, or both, as shown in FIG. 4, each feature 14 must be visible through the product 16. Therefore, several conditions may be required. First, each feature 14 must permit the visibility of any other feature 14; second, the base 12 and the bottom 112 must both be transparent if, for example, the feature 14 is located on the base 12, and third, the insert 110 must be transparent if, for example, the feature 14 is on the bottom 112. In addition, the feature 14 affixed to any of the faces 122, 124 of the bottom or the surfaces 22, 24 of the base must permit visibility of the other feature. When a feature 14 is placed on the lower face 124 of the bottom 112 or the upper surface 22 of the base 12, the transparent insert 110 acts as the divider 26. After the feature 14 is placed on any of the surfaces 22, 24 or faces 122, 124, the cosmetic product 16 is poured into the insert 110, and the insert 110 is placed into the chamber of the container.

The clear cosmetic product 16 can be a fluid or alternatively, it can be a clear gel. The fluid can be any aqueous or nonaqueous liquid that permits the decorative feature 14 to be viewed. However, if the cosmetic product 16 is a clear gel, it can be any clear gel known in the art comprising a gellant, such as for example, dextrin fatty acid esters, carbopols, nylon polymers, dibenzyl monosorbitol acetal, and the like. The clear cosmetic gel of this kind has been previously disclosed, for example, in Japan Patent Application No. 09-235210. For example, use of dextrin fatty acid esters in transparent cosmetics are described in Japanese Patent Application Nos. 02-269563 and 08-069359, and in general cosmetic products are described in Japanese Patent No. JP 2258710, JP 62143971, JP 61069411, and JP 4149116 and Japanese Patent Application No. 03-232389, and are available commercially from sources such as, for example, Ikeda Corporation, Tokyo, Japan under the tradename of "Rheopearl KS". However, its use has not previously been described in cosmetic packaging to achieve the optical integration of a decorative feature with a clear cosmetic product.

When the clear cosmetic gel comprises dextrin fatty acid ester as the gellant, it is combined with an oil component. The oil component can include any type of cosmetically acceptable oil including oily esters depending on the application of the product. The type of oil chosen can depend on the nature of the other component to be added, and its compatibility with the decorative feature 14. Examples include, but are not limited to, isoparaffins, fluid paraffins, squalane, isopropyl myristate, neopentyl glycol dicarpate, almond oil, rapeseed oil, soybean oil, oleic acid, linoleic acid, oleyl alcohol, isostearyl alcohol and methylphenylpolysiloxane. Preferably the oil is a non-volatile hydrocarbon. Suitable non-volatile hydrocarbons include but arc not limited to isoparaffins, squalane, or petrolatum, or mixtures thereof The hydrocarbon oil is present in an amount of about 20 to about 60 percent by weight of the composition. More preferably, the hydrocarbon oil is polymeric and has a high average molecular weight of about 800 to 1,200, as for example, polyisobutene, or polydecene.

The other component, the dextrin fatty acid ester, is prepared by esterifying a mixture of a dextrin or reduced dextrin having an average glucose polymerization degree of 3 to 100 with a 8 to 14 carbon saturated fatty acid in the presence of water or alcohol until the substitution degree of the saturated fatty acid is 1.2 to 2.4 glucose units. Dextrin fatty acid esters can be esters of dextrin and higher fatty acids of 12 to 22 carbons. Examples of such dextrin fatty acid esters include dextrin palmitate, dextrin behenate, dextrin stearate, dextrin myristate, and dextn laurate. The dextrin fatty acid ester is present in the amount of about 1 to 25 percent of the weight of the composition, preferably from about 5 to 15 percent.

The clear cosmetic product 16 can be, but is not limited to, a lip gloss or other lip product, a solid or liquid fragrance or perfume product, cleanser, toner, an eye product, such as a gel or gloss, and any other makeup, or skin or sun care product that is substantially clear. In a preferred embodiment, the product 16 is an eye product, a lip product, or a fragrance or perfume product. The lip or perfume product has a clarity such that the design feature 14 at the base 12 of the container 10 can be observed through the lip product 16 and the feature 14 is optically integral with the product 16. The decorative feature 14 is an image that appears to actually be a part of the clear lip product 16; yet, the image is not disturbed by removal of the product 16 from the chamber and remains intact during the entire life of the product 16. The preferred perfume product 16 contains from about 0.01 to about 50.00 percent fragrance by weight of the clear perfume product 16.

The preferred lip product is a lip gloss which may have a tint-like color. Additional preferred components of the cosmetic product 16 include one or more colorants. The term "colorant" as used herein includes pigments, dyes, stains, and the like. The use of the colorant must maintain the clarity of the product 16 so that the design 14 remains observable through the product 16 and remains observable as part of the product. Any cosmetically acceptable colorant, organic, inorganic, or combinations thereof, can be used in the cosmetic products 16. Preferably, the colorant is an organic pigment and the color of the product 16 after addition of the organic pigment is a tint. The organic pigment can be, for example, natural pigments, monomeric and polymeric synthetic pigments, or combinations thereof. Exemplary organic pigments include, but are not limited to, phthalocyanine blue and green pigments and azo-type red pigments such as naphthol red pigment. Other suitable aromatic pigment compounds include, but are not limited to, azo, triphenyl methane, indigo, anthraquinone, and xanthine dyes which are referred to as D&C, and FD&C pigments, such as for example, FD&C blue No. 1, FD&C green No. 5, FD&C red No. 40, and FD&C yellow No. 5. Also useful are lakes, which are pigments formed by the precipitation and absorption of organic dyes in an insoluble base, such as alumina, barium, or calcium hydrates. Particularly preferred lakes are primary FD&C or D&C Lakes and blends thereof. Colorant concentrations will vary depending upon the desired color or tint of the cosmetic product, but generally will be in the range of from about 0.1 to about 10.0 percent by weight of the total composition.

The colorant can also be an inorganic pigment. The inorganic pigment is present in low amounts and preferably, the inorganic pigment has a small particle size, for example, a submicron particle size that will disperse and permit the cosmetic product to maintain a clear appearance. Examples of inorganic pigments include, but are not limited to, iron oxides (yellow, red, brown or black), ultramarines, chromium hydroxide green, chromium oxide, titanium dioxide (white), ferric ferrocyanide, ferric ammonium ferrocyanide, and mixtures thereof.

Further, the clear cosmetic product 16 can contain other optional components as long as they do not interfere with the clarity of the product 16. Examples include, but are not limited to, one or more preservatives such as, for example, propyl paraben, butyl paraben, mixtures thereof, or isoforms thereof, as well as butyl hydroxy toluene or butyl hydroxy anisol (BHT or BHA); chelating agents such as disodium ethylene diamine tetra acetic acid ("EDTA"); fragrances (such as pinene); flavoring agents; waterproofing agents (such as PVP/eicosene copolymer); surfactants, such as silicone copolyols or fatty acid glycerol esters; and oil-soluble actives, such as tocopherol and its derivatives or retinol and its derivatives, and the like.

The type of container 10 can be any package that will contain the cosmetic product 16. Examples of containers 10 include, but are not limited to, pots, compacts, bottles and jars of varying shapes and sizes. The type of container 10 of the present invention provides an advantage over previous packaging known in the art. The clear cosmetic product 16 is in and of itself appealing, however, it additionally permits the constant viewing of the decorative feature 14 at the base 12 of the container or the bottom 112 of the insert such that the image of the feature 14 appears to be in the product 16 itself This provides further and prolonged visual interest and enjoyment of the feature 14, which continuously appears at the top of the surface of the product 16. The feature 14 does not diminish as the product 16 is removed from the container 10 during use.

Preferably, the container 10 has a lid or cover 20 attached to the base 12 to protect the cosmetic product. The lid 20 can be of any kind used and known in the art such as for example, a screw lid, or a snap lid. Further, the lid 20 can be transparent. In a preferred embodiment, the container 10 is a pot or a compact. In addition, the sidewall 18 of the base 12 can be transparent when the product 16 is held in the chamber of the container 10, and when the product 16 is contained in the insert 110, both the sidewall 18 and the rim 1 18 of the insert can be transparent for further enjoyment and a greater view of the decorative feature 14. When the sidewall 18 or the rim 118 is transparent, the decorative feature 14 can also be placed on the sidewall 18 or the rim 118.

The invention is further illustrated by the following non-limiting examples.

EXAMPLES

II. Clear Fragrance Formulation with Mirror

| Material | Weight % |
|---|---|
| Polyisobutene | 35.0 |
| Polydecene | 50.0 |
| Dextrin myristate | 10.0 |
| BHT | 0.2 |
| Fragrance | 4.8 |

The feature is a mirror affixed to the upper surface of the base. The constituents of the above formula are mixed thoroughly together. Any standard homogenizing or nixing apparatus known in the art can be used to carry out the mixing operation. The mixture is heated to between 90° C. and 100 ° C. Once the mixture is clear and solubilized, the clear fragrance formulation is poured at a temperature between 80° C. to 90° C. into the chamber of the base of the compact. Images reflected in the mirror appear to be optically integral with the clear fragrance product.

II. Lip Gloss Formulation with Raised Relief

| Material | Weight % |
|---|---|
| Polyisobutene | 38.8 |
| Polydecene | 50.0 |
| Dextrin palmitate | 11.0 |
| BHT | 0.2 |

The bottom of an insert is pressed with a die to form a raised relief decorative feature on the bottom of the insert. The formulation is prepared according to the steps outlined in Example I. The lip gloss formulation is hot poured into the insert having the raised relief decorative feature. The insert is placed into a lip pot. The relief appears to be optically integral with the clear lip product.

What we claim is:

1. A container for receiving a clear cosmetic product, said container comprising a base and at least one sidewall extending upwardly from said base and defining at least one internal chamber, said clear cosmetic product being contained in said chamber, and said base having an upper and a lower surface, at least one of said surfaces having at least one decorative feature, said decorative feature being visible through and optically integral with said clear cosmetic product.

2. The container of claim 1 wherein said decorative feature is provided on said upper surface.

3. The container of claim 2 wherein said decorative feature is separated from said product by a clear divider.

4. The container of claim 1 wherein said decorative feature is provided on said lower surface and said base is transparent.

5. The container of claim 1 further comprising a plurality of decorative features optically integral with said product provided on said upper and lower surfaces.

6. The container of claim 1 wherein said clear cosmetic product is a fluid.

7. The container of claim 1 wherein said clear cosmetic product is a gel.

8. The container of claim 7 wherein said gel comprises a gellant selected from the group consisting of a dextrin fatty acid ester, carbopols, nylon polymers, and dibenzyl monosorbitol acetal.

9. The container of claim 8 wherein said gellant is dextrin fatty acid ester.

10. The container of claim 9 wherein said ester is selected from the group consisting of dextrin palmitate, dextrin behenate, dextrin stearate, dextrin myristate, and dextrin laurate.

11. The container of claim 10 wherein said ester is dextrin myristate.

12. The container of claim 9 wherein said ester is present in an amount of about at least about 1 to about 25 percent by weight.

13. The container of claim 1 wherein said decorative feature is affixed to said base.

14. The container of claim 13 wherein said decorative feature is selected from the group consisting of a print, a hologram, a metallic film, a photograph, a relief, a mirror, and any combination thereof.

15. The container of claim 14 wherein said decorative feature is a mirror.

16. The container of claim 14 wherein said decorative feature is a hologram.

17. The container of claim 1 wherein said decorative feature is integral with said base.

18. The container of claim 1 further comprising a lid.

19. The container of claim 18 wherein said clear product is selected from the group consisting of a fragrance product, a cleanser, a toner, an eye product, a lip product, a makeup product, a skin care product, and a sun care product.

20. The container of claim 1 wherein said clear product further comprises one or more colorants.

21. A container for receiving a clear cosmetic product, said container comprising a base and at least one sidewall extending upwardly from said base and defining at least one internal chamber, said chamber holding an insert having a bottom and a rim contiguous with said base and said sidewall, said clear cosmetic product being contained in said insert, said bottom having an upper and a lower face, said base having an upper and a lower surface, and at least one of said surfaces having at least one decorative feature being visible through and optically integral with said clear cosmetic product.

22. The container of claim 21 wherein at least one of said decorative features is provided on said upper face and is separated from said product by a clear divider.

23. The container of claim 21 wherein at least one of said decorative features is provided on said lower face and said bottom is transparent.

24. The container of claim 21 further comprising a plurality of decorative features optically integral with said clear product provided on said upper and lower faces, and said bottom is transparent.

25. The container of claim 21 wherein at least one of said decorative features is provided on said upper surface of said base and said bottom is transparent.

26. The container of claim 21 wherein at least one of said decorative features is provided on said lower surface and said base is transparent.

27. The container of claim 21 further comprises a plurality of decorative features optically integral with said product provided on said upper and lower surfaces and said base is transparent.

28. A method of making a container having a base and at least one sidewall extending upwardly from the base and defining at least one chamber for holding a clear cosmetic product having at least one decorative feature visible throughout and optically integrated within the product, the base having upper and lower surfaces, comprising the steps of setting the decorative feature on one of the surfaces, and pouring the clear cosmetic product in the chamber and over the decorative feature.

29. A method of making a container having a base and at least one sidewall extending upwardly from the base and defining at least one chamber for holding an insert having a bottom and a rim contiguous with said base and said sidewall, the bottom having upper and lower faces, the insert containing a clear cosmetic product having at least one decorative feature visible throughout and optically integrated within the product, comprising the steps of setting the decorative feature on of the faces, pouring a clear cosmetic product in the insert and over the decorative feature, and placing the insert in the chamber of the container.

* * * * *